United States Patent [19]

Hansson

[11] Patent Number: 4,713,093

[45] Date of Patent: Dec. 15, 1987

[54] ELECTROSTATIC DUST PRECIPITATOR

[75] Inventor: Curt Hansson, Västra Frölunda, Sweden

[73] Assignee: Kraftelektronik AB, Surte, Sweden

[21] Appl. No.: 883,356

[22] Filed: Jul. 8, 1986

[30] Foreign Application Priority Data

Jul. 15, 1985 [EP] European Pat. Off. ..... 85850238.8

[51] Int. Cl.[4] ..... B03C 3/02

[52] U.S. Cl. ..... 55/139; 55/2

[58] Field of Search ..... 55/2, 105, 139; 323/903

[56] References Cited

U.S. PATENT DOCUMENTS

| | | | |
|---|---|---|---|
| 3,916,284 | 10/1975 | Hilgendorf | 363/10 |
| 3,981,695 | 9/1976 | Fuchs | 55/2 |
| 4,152,759 | 5/1979 | Hedberg | 363/160 |
| 4,400,662 | 8/1983 | Coe | 55/139 |
| 4,533,987 | 8/1985 | Tornofugi et al. | 363/36 |

FOREIGN PATENT DOCUMENTS

| | | | |
|---|---|---|---|
| 3403619 | 8/1984 | Fed. Rep. of Germany | 55/139 |

*Primary Examiner*—Bernard Nozick

*Attorney, Agent, or Firm*—Fleit, Jacobson, Cohn & Price

[57] ABSTRACT

An electrostatic dust precipitator comprises a separation filter (5) having emitter and collector electrodes (4,6), means (1–3) for maintaining a substantially constant d.c. voltage between the electrodes (4,6) during operation of the precipitator, and pulse-generating means (1–3, 7–11) for generating at a given frequency in the order of 30–500 Hz voltage pulses or voltage pulse trains which are superimposed on the d.c. voltage and which are of short duration in relation to the aforesaid frequency. The pulse-generating means (1–3, 7–11) includes capacitive and inductive elements (7,8) which together with the capacitance of the separation filter (5) form an electrical oscillation circuit, and a switching device (9) which is incorporated in said circuit and which is periodically actuatable by a control means (11) for activation of the oscillation circuit (5,7,8). The pulse-generating means (1–3, 7–11) further includes a known voltage-controlled frequency converter (1) which is arranged to generate an a.c. voltage having a frequency which is at least three times higher than the frequency of the voltage pulses or voltage pulse trains, and a single-phase transformer (1) which is connected downstream of the frequency converter (1) and followed by a rectifier (3).

1 Claim, 3 Drawing Figures

ELECTROSTATIC DUST PRECIPITATOR

Figure 1:
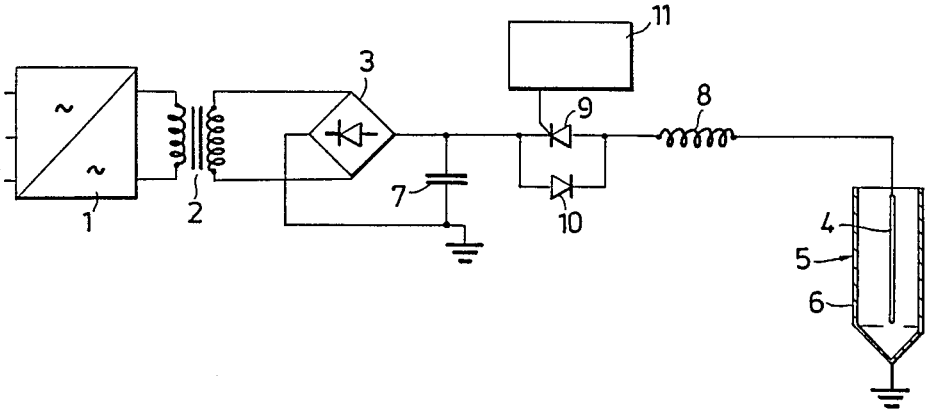

The present invention relates to an electrostatic dust precipitator which comprises a separation filter having emitter and collector electrodes, means for maintaining a pre-determined substantially constant d.c. voltage between the electrodes during operation of the precipitator, and pulse-generating means for generating at a given frequency in the order of 30–500 Hz voltage pulses or voltage pulse trains which are superimposed on said d.c. voltage and which are of short duration in relation to said frequency, said pulse-generating means including capacitive and inductive elements which together with the capacitance of the separation filter form an electrical oscillation circuit, and a switching device which is incorporated in said oscillation circuit and which is periodically actuatable by control means for activation of the oscillation circuit.

Electrostatic precipitators have long been used in industry for the purpose of cleansing gas of dust entrained therewith, and especially for extracting soot particles from flue gases. The aforedescribed technique of superimposing on the d.c. voltage between the electrodes of the precipitator short voltage pulses or voltage pulse trains at long intermediate pulse or pulse-train intervals in relation to the duration of the pulses or pulse trains has long been applied in the art in order to obtain a more uniform distribution of dust on the precipitation electrodes.

The supply of voltage to the means for generating the aforesaid voltage pulses or voltage pulse trains is normally effected through a tranformer which transforms, for exemple, a 50 Hz, 380 V mains voltage to an a.c. voltage of, for example, 40–200 kV, this voltage then being rectified to form a pulsatile d.c. voltage. This pulsatile d.c. voltage can also be used for the normal supply of voltage to the electrodes of the dust precipitator and the magnitude of the voltage is then placed immediately beneath that voltage level which in the continuous operation of the precipitator results in breakdown, in the form of a glow discharge in the separation filter.

It is desirable to be able to impart an optional shape and amplitude to the superimposed voltage pulses or voltage pulse trains. More specifically, there are often desired voltage peaks of such height that the voltage across the precipitator electrodes briefly reaches a voltage level which lies immediately beneath the voltage at which non-permitted arcing takes place between the precipitator electrodes, even when the voltage supply is of short duration.

The known method of using a conventional transformer for transforming mains voltage to a voltage adapted for the voltage supply to the aforesaid pulse-generating or pulse-train generating means, and optionally also to the remainder of the dust precipitator, results in a supply voltage which pulsates at such low frequency that a complete re-charge of the capacitive elements incorporates in said pulse-generating means is not always obtained after a voltage pulse or voltage pulse train, therewith causing the amplitude of the following pulse or pulse train to be lower than the optimal. When generating superimposed pulses or pulse trains of relatively low frequency, this disadvantage can be overcome, either completely or in part, by stepping up the mains voltage with the aid of a three-phase transformer. A three-phase transformer, however, has the disadvantage of being expensive and, as with conventional single-phase transformers for transforming a.c. voltage of mains frequency, having a considerable weight.

Accordingly, the object of the present invention is to provide a novel and useful arrangement with which the aforediscussed disadvantages are avoided to at least a substantial extent.

This object is achieved in accordance with the present invention in that the pulse-generating means of an electrostatic precipitator of the kind described in the introduction includes a known voltage-controlled frequency converter which is arranged to generate an a.c. voltage having a frequency which is at least three times higher than the frequency of said voltage pulses, or trains of pulses, and a single-phase transformer which is connected downstream of said converter and followed by a rectifier. This arrangement advantageously obviates the need of an expensive three-phase transformer, and the increase in frequency afforded in accordance with the invention substantially decreases the costs for and the weight of the single-phase transformer coupled downstream of the converter comparison with a single-phase transformer for stepping up a.c. voltage of mains frequency.

The invention will now be described in more detail with reference to an embodiment thereof illustrated schematically in the accompanying drawing, in which FIG. 1 is a circuit diagram of an electrostatic dust precipitator according to the invention, and FIG. *2a* and *2b* illustrate diagrammatically and respectively the voltage across the capacitor and the voltage across the filter when the dust precipitator according to the invention is in operation.

In FIG. 1 the reference 1 identifies a schematically illustrated conventional voltage, controlled frequency converter, this converter being supplied, for example, from a three-phase a.c. mains voltage supply, and produces a substantial increase in the frequency of the applied a.c. voltage. For example, the converter 1 can be arranged to generate from an input three-phase voltage of 380 V and a frequency of 50 Hz, a substantially constant single phase a.c. voltage of 380 V and a frequency which lies within the range of 1–25 kHz. Connected to the output of the converter 1 is a single-phase transformer 2, in which the output voltage of the converter is increased to a substantially constant a.c. voltage having a voltage value lying within, for example, 40–200 kV. This a.c. voltage is rectified in a rectifier bridge 3 whose positive terminal is connected to earth, whereas its negative terminal, which is held at a substantially negative voltage $U_B$, via components hereinafter described, is connected to the emitter electrode 4 of the separation filter 5 of the illustrated dust precipitator. The emitter electrode 4 is housed in a conventional manner in an earthed casing 6 forming the collector electrode.

Connected between the d.c. terminal of the rectifier bridge 3 is a capacitor 7, the one terminal of which is thus earthed and the other terminal of which receives negative voltage from the bridge 3. Connected in series between said other terminal of the capacitor 7 and the emitter electrode 4 is an inductance 8 and a parallel-coupling of a thyristor 9, or thyristor chain, and a diode 10, or diode chain. The thyristor 9, or the thyristors, and the diode 10, or the diodes, are connected in mutually oppositely directed conductor directions, more specifically so that the diode, or the diodes, has, or have, a blocking effect in a direction towards the bridge 3, and the thyristor, or the thyristors, has, or have, a blocking effect in a direction towards the filter 5.

An ignition circuit 11 is adapted to ignite the thyristor 9, or the thyristors, at a predetermined adjustable frequency in the order of 30–500 Hz for a relatively short period of time in relation to the ignition frequency. It will be recognized that the filter 5 can, in the main, be likened to a capacitor in which the capacitor plates are formed by the electrodes 4,6. The capacitor 7, the inductance 8 and the filter 5 thus form an oscillation circuit, so that when the thyristor 9 is ignited and current is flowing therethrough, there is obtained an abrupt increase in the voltage $U_F$ across the filter 5 (increase in the negative potential of the emitter electrode 4) and a decrease in the voltage $U_C$ across the capacitor 7. The circuit will then change to a reverse mode, during which current flows through the diode 10, or the chain of diodes, so that the voltage $U_F$ across the filter again falls abruptly to a level in the proximity of the intended holding voltage $U_H$ and the voltage $U_C$ across the capacitor 7 is again increased to a level in the proximity of the output voltage $U_B$ of the rectifying bridge 3.

Figure 2A:
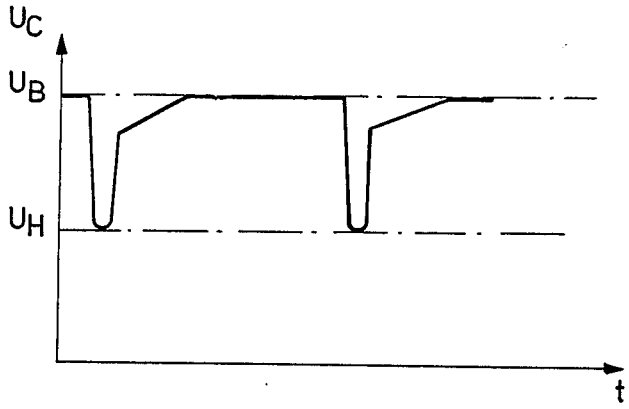
Figure 2B:
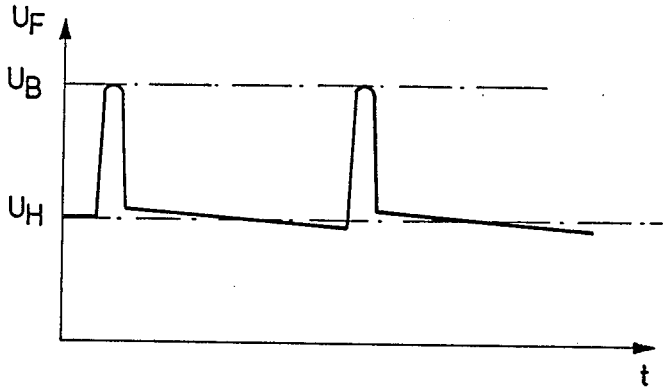

FIGS. 2*a* and 2*b* are diagrams which show the respective variations in time of the capacitor voltage $U_C$ and the filter voltage $U_F$ upon applying to the thyristor 9, or the chain of thyristors, ignition pulses of such short duration that the oscillation circuit effects solely one complete oscillation cycle, and when using the components 1, 2 and 3 also for normal voltage supply to the filter 5. In the diagrams, which illustrate the conditions prevailing when the capacitances of the capacitor 7 and the filter 5 are mutually equal, the desired holding voltage $U_H$ between the electrodes and the output voltage $U_B$ of the rectifier bridge 3 are shown in morse lines. As beforementioned, the voltages $U_C$ and $U_F$ are negative. Consequently, upon ignition of the thyristor 9, or the thyristors, current flows swiftly from the filter 5 to the capacitor 7, causing $U_C$ to fall and $U_F$ to rise to a corresponding extent, whereupon the oscillation circuit 5, 7, 8 reverses its mode so that $U_C$ again increases and $U_F$ falls. This reversal is not complete, however, since during each reversal the capacitor 7 delivers voltage to the filter 5. This can be seen from the diagram of FIG. 2*a*, in which the voltage curve $U_C$ where it slopes towards the $U_B$-level subsequent to reversal upwardly represents re-charging of the capacitor 7 with the aid of the components 1, 2, 3 to a voltage corresponding to the output voltage of the bridge 3. In addition the voltage peaks of the filter voltage $U_F$ commence at a lower level than that at which they terminate, and the filter voltage $U_F$ between the voltage peaks falls as a result of the discharge which takes place in the filter 5. If desired, the holding voltage between the electrodes 4, 6 can be maintained with the aid of a separate voltage supply circuit. Furthermore, the thyristor 9, or the thyristors, can be held ignited over a period of such duration that a plurality of oscillation periods are carried out and therewith a voltage pulse train is generated between the filter electrodes 4, 6.

The arrangement according to the invention affords considerable economic benefits and savings in weight and space. By using a frequency converter in accordance with the invention, which converter greatly increases the frequency of the applied voltage, only a relatively small and inexpensive transformer, with a low-weight core, is needed to increase the voltage to a value suitable for filter operation. The arrangement according to the invention also provides for a considerably higher electrical efficiency that that achieved with conventional voltage supply systems for electrostatic dust precipitators. In addition hereto, the use of the arrangement according to the invention also enables the voltage supply to the precipitator electrodes to be controlled continuously with the aid of single and inexpensive means in a manner which is extremely accurate and which reacts quickly to changes in the operating conditions which require corrections. The dust precipitator can be powered by a three-phase voltage without requiring the provision of an expensive three-phase transformer. The possibility of powering the precipitator with a three-phase voltage is highly beneficial, and is often desired from the technical aspect of the plant.

I claim:

1. An electrostatic dust precipitator comprising a separation filter having emitter ad collector electrodes means connected to said electrodes for maintaining a pre-determined substantially constant d.c. voltage therebetween during operation of the precipitator, and pulse-generating means connected to the electrodes for generating at a given frequency in the order of 30–500 Hz voltage pulses or voltage pulse trains which are superimposed on said d.c. voltage and which are of short duration in relation to said frequency, said pulse-generating means including capacitive ad inductive elements connected in a manner to form, together with a capacitance provided by the separation filter, an electrical oscillation circuit, and a switching device which is incorporated in said oscillation circuit and which is periodically actuatable by a control means for activation of the oscillation circuit, wherein the pulse-generating means upstream said oscillation circuit further includes a voltage-controlled frequency converter arranged to generate an a.c. voltage having a frequency which is at least three times higher than the frequency of said voltage pulses or trains of pulses, and a single-phase transformer connected downstream of said converter and followed by a rectifier.

* * * * *